US007712839B1

(12) United States Patent
Chen

(10) Patent No.: US 7,712,839 B1
(45) Date of Patent: May 11, 2010

(54) TILES OR BRICKS SHOVELING DEVICE

(76) Inventor: Yuehting Chen, P.O. Box 44-2049, Taipei (TW) 10668

( * ) Notice: Subject to any disclaimer, the term of this patent is extended or adjusted under 35 U.S.C. 154(b) by 0 days.

(21) Appl. No.: 12/453,279

(22) Filed: May 6, 2009

(51) Int. Cl.
*A47L 11/12* (2006.01)

(52) U.S. Cl. ..... 299/37.1; 15/93.1; 30/170

(58) Field of Classification Search ..... 299/36.1, 299/37.1; 15/93.1; 30/170; 156/344, 584
See application file for complete search history.

(56) References Cited

U.S. PATENT DOCUMENTS 2,874,946 A * 2/1959 Singleterry et al. ..... 299/37.1
6,135,566 A * 10/2000 Anderson ..... 299/37.1

FOREIGN PATENT DOCUMENTS

GB 2148770 A * 6/1985

* cited by examiner

*Primary Examiner*—Sunil Singh

(57) ABSTRACT

A tiles or bricks shoveling device includes a body having front wheels and rear wheels, and a handle is connected to a rear end of the body. A motor is connected to the body and drives a circular member by its eccentric shaft. A block is fixed to the body and two posts movably extend through the block. A front board and a rear board are connected to the front and rear ends of the posts. Two springs are connected to the two posts to return the rear board. A shoveling blade is connected to the front end of the front board such that when the motor is activated, the posts are moved reciprocally and the shoveling blade moves linearly back and forth with the front board to shovel the tiles and bricks up.

6 Claims, 9 Drawing Sheets

TILES OR BRICKS SHOVELING DEVICE

BACKGROUND OF THE INVENTION (1) Field of the Invention

The present invention relates to a shoveling device, and more particularly, to a tile shoveling device with a linearly reciprocated blade to shovel up tiles or bricks and the tile shoveling device is operated with less vibration.

(2) Description of the Prior Art

A conventional tile shoveling device is shown in FIG. 1 and generally includes a body 10 with front and rear wheels 11 on two sides thereof and a shoveling blade 12 is connected to the front end of the body 10 so as to shovel the tiles or bricks up. The shoveling blade 12 is powered by a motor which drives an eccentric shaft 13 to move a reciprocating link 14 and a frame 15 is connected to the reciprocating link 14. The shoveling blade 12 is connected to the frame 15 such that when the motor drives the eccentric shaft 13, the reciprocating link 14 moves the frame 15 and the shoveling blade 12 to move in reciprocation manner to shovel the tiles or bricks up.

However, the movement of the reciprocating link 14 does not move linearly, it actually swings about the eccentric shaft 13 and moves back and forth. The movement makes the body hard to control, the user has to hold the handle tightly to reduce the shaking during use. In order to improve the operation of the shoveling device, two dampers 16 such as two rubber cylinders are connected with the frame 15 to absorb the shaking.

The dampers 16 can only reduce limited shaking of the body 10 and also reduce the efficiency of the motor, the force that the shoveling blade 12 applies to the tiles or bricks becomes less than expected. Besides, the dampers 16 are damaged quickly.

The present invention intends to provide a tiles or bricks shoveling device which has less shaking during use and the shoveling blade moves linearly to effectively shovel the tiles or bricks.

SUMMARY OF THE INVENTION

The present invention relates to a tiles or bricks shoveling device which comprises a body having front wheels and rear wheels and a handle is connected to the rear end of the body. A motor is connected to the body and includes an eccentric shaft which drives a circular member. A reciprocation unit includes a block fixed to the body and at least one post movably extends through the block. A front board and a rear board are connected to the front and rear end of the at least one post respectively. A spring is connected to the at least one post so as to return the rear board when the at least one post is moved back and forth by the circular member. A shoveling blade is connected to the front end of the front board and moves linearly with the front board.

The primary object of the present invention is to provide a tiles or bricks shoveling device wherein the shoveling blade moves linearly without shaking or swing.

Another object of the present invention is to provide a tiles or bricks shoveling device wherein the shoveling blade is operated without shaking or swing so as to keep the motor working in high efficiency.

Yet another object of the present invention is to provide a tiles or bricks shoveling device wherein the tilt angle of the shoveling blade can be adjusted by operation of a pedal at the rear end of the body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
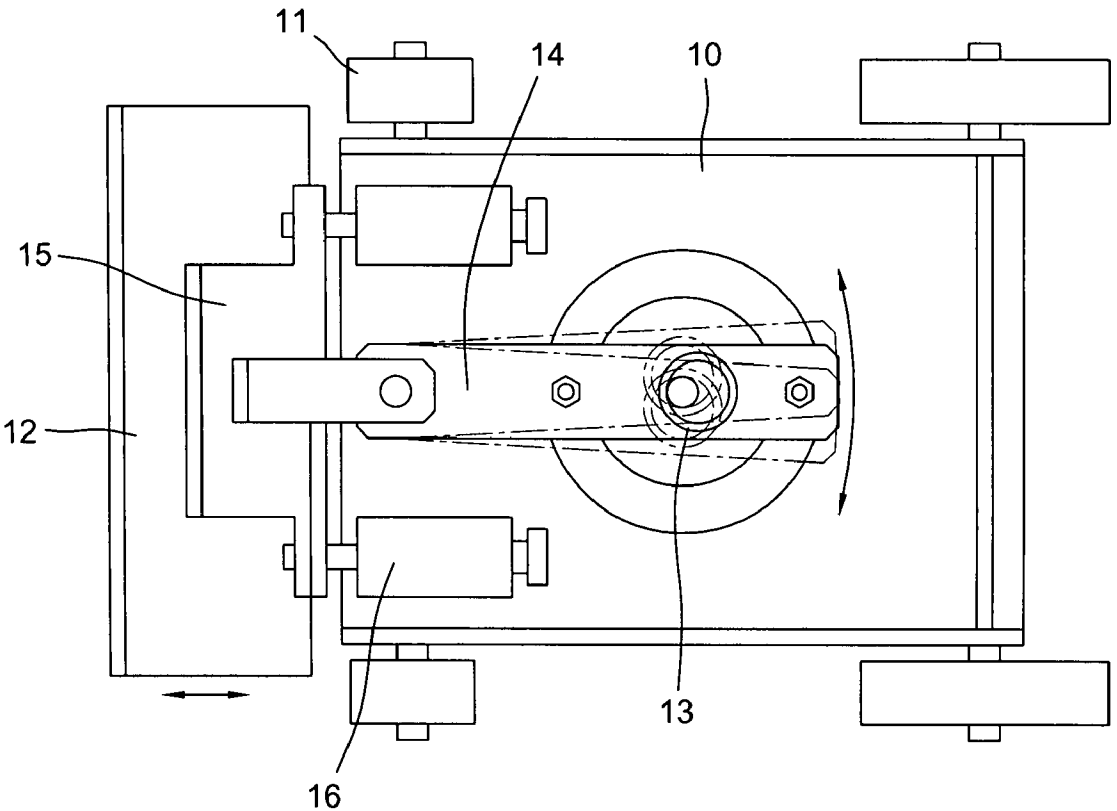
FIG.1 Prior Art
FIG. 1 shows a conventional shoveling device.
Figure 2:
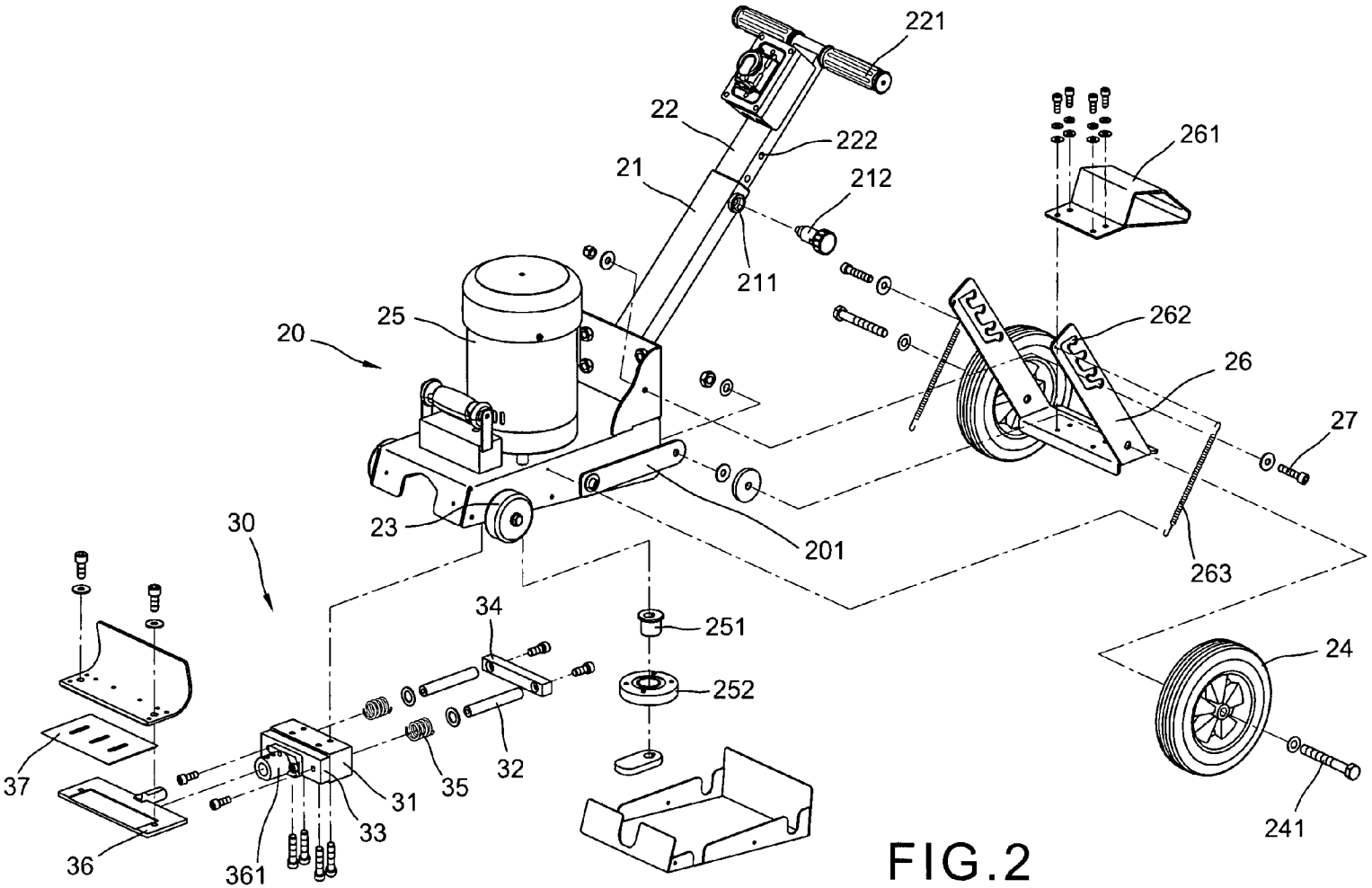
FIG. 2 is an exploded view to show the shoveling device of the present invention.
Figure 3:
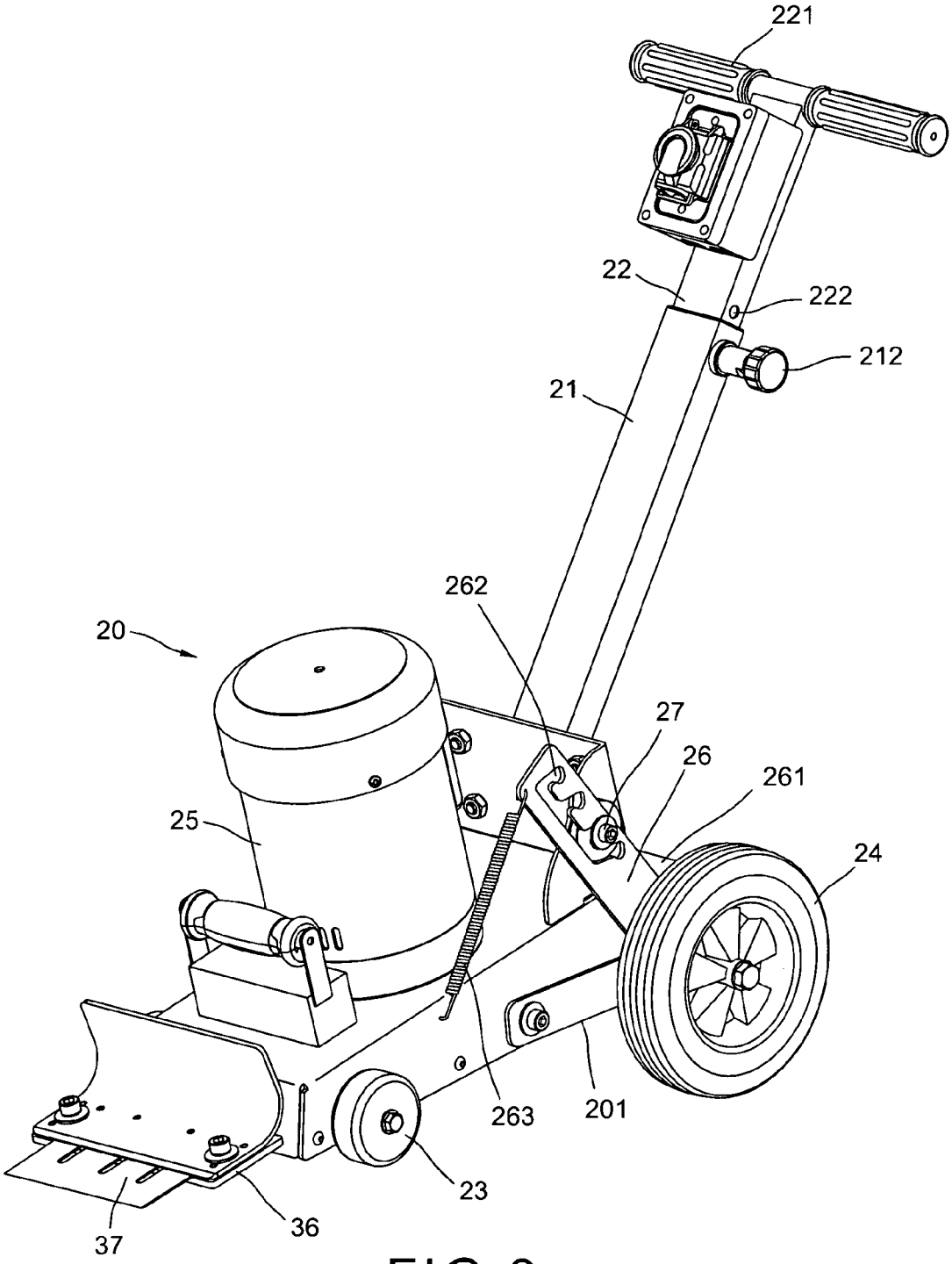
FIG. 3 is a perspective view to show the shoveling device of the present invention.
Figure 4:
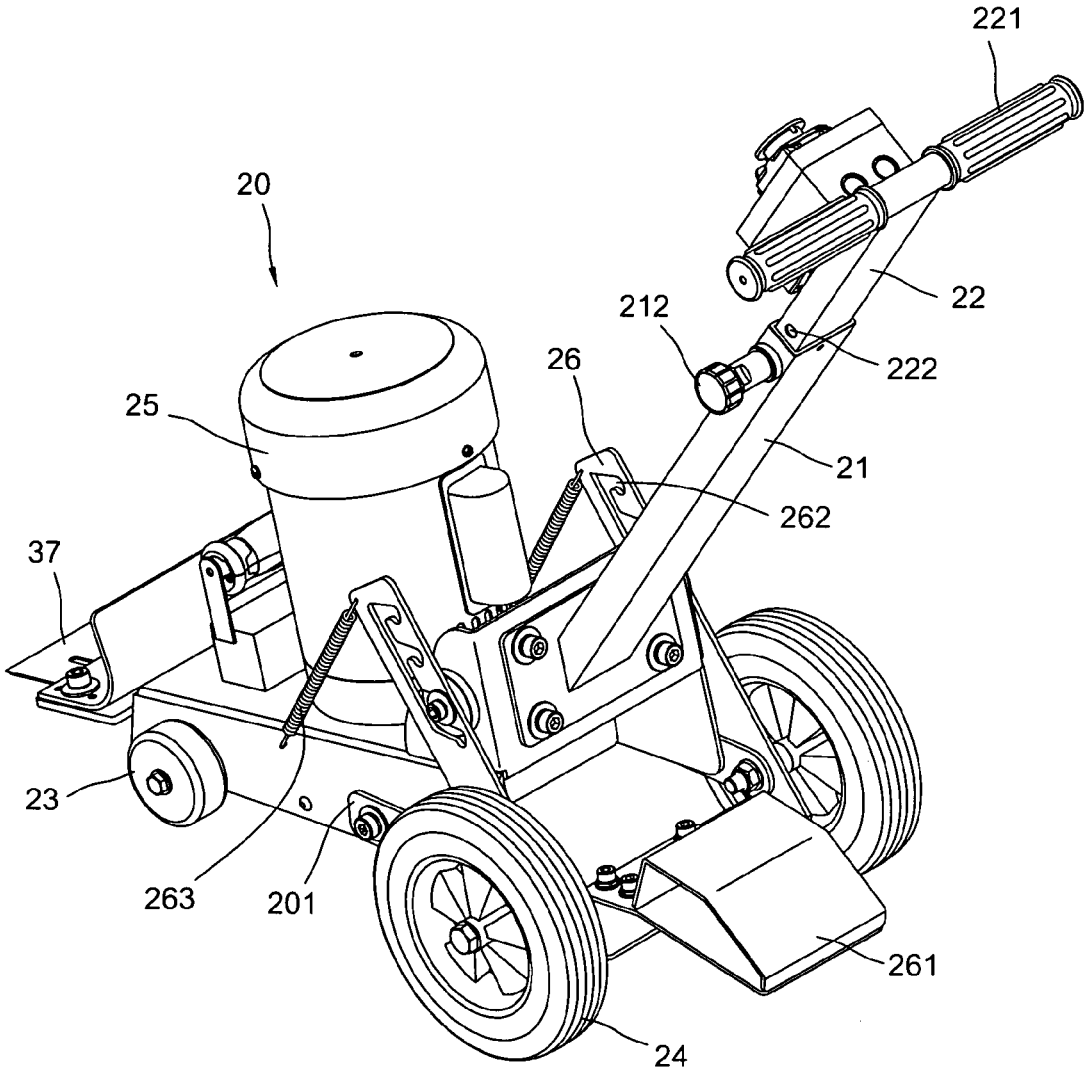
FIG. 4 is a perspective view showing the shoveling device of the present invention from another angle.
Figure 9:
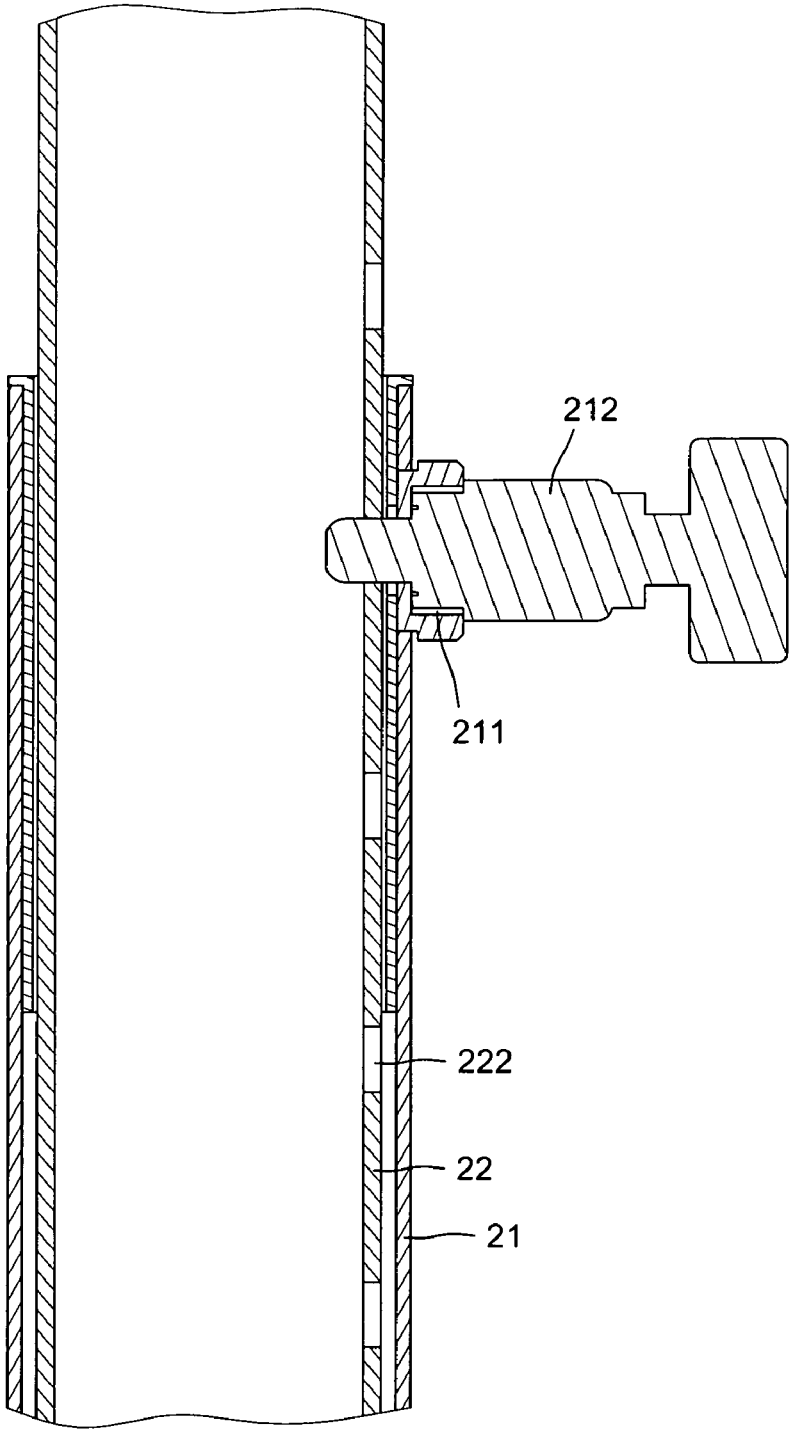
FIG. 9 is a cross sectional view to show that the positioning pin is engaged with one of the holes in the inner tube.

Referring to FIGS. 2 to 4, the tiles or bricks shoveling device of the present invention comprises a body 20 having front wheels 23 and rear wheels 24 connected thereto and a motor 25 is connected to a top of the body 20. An outer tube 21 extends from the rear end of the body 20 and an inner tube 22 is retractably inserted into the outer tube 21. The inner tube 22 is connected with a handle 221. A through hole 211 is defined through a wall of the outer tube 21 and the inner tube 22 has multiple holes 222. A positioning pin 212 extends through the through hole 211 and is engaged with one of the holes 222 to position the inner tube 22 relative to the outer tube 21 as shown in FIG. 9.

The motor 25 includes an eccentric shaft 251 which protrudes from the underside of the body 20 and drives a circular member 252. A reciprocation unit 30 is connected to the underside of the body 20 and includes a block 31 fixed to the body 20. Two posts 32 movably extend through the block 31 and two springs 35 are mounted to the two posts 32. A front board 33 is connected to the front ends of the posts 32 and a rear board 34 is connected to the rear ends of the posts 32. The springs 35 are biased between the block 31 and the rear board 34 so as to return the rear board 34 when the rear board 34 is not pushed by the circular member 252. A tubular blade frame 361 is connected to the front board 33 and a connection plate 36 is connected to the blade frame 361. A shoveling blade 37 is connected to the connection plate 36.

An operation pedal 261 is connected between the two rear wheels 24 and an adjustment unit is connected to the operation pedal 261. The adjustment unit includes two adjustment plates 26 and each adjustment plate 26 includes multiple positioning slots 262. A spring 263 is connected between one of the two adjustment plates 26 and the body 20. Two engaging bolts 27 are located on two sides of the body 20 and each are engaged with one of the positioning slots 262 of the adjustment plate 26 corresponding thereto. The adjustment unit is pivotably connected to two respective axles 241 of the two rear wheels 24. Two links 201 are pivotably connected between the body 20 and the two axles 241 of the two rear wheels 24.

Figure 5:
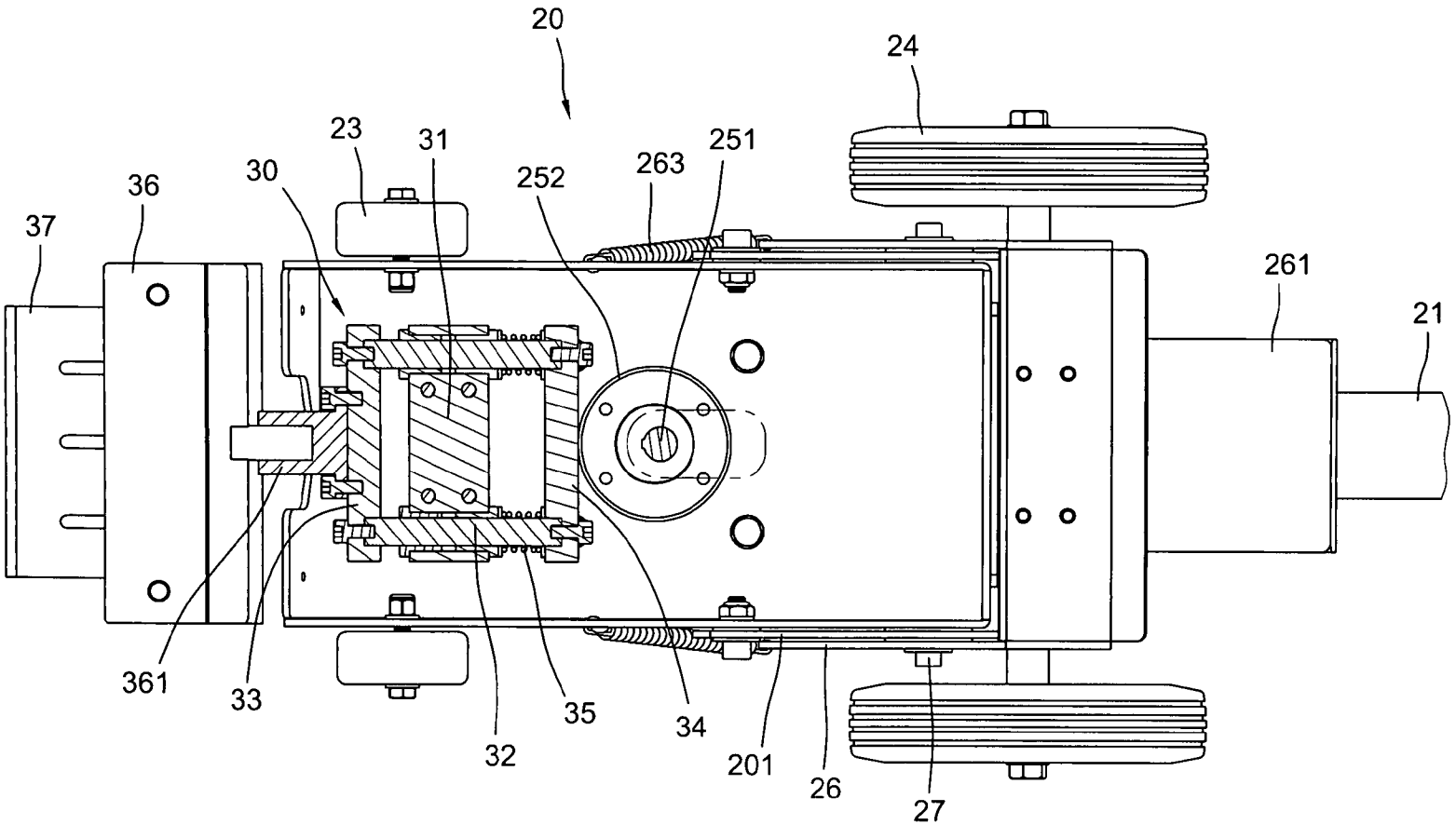
FIG. 5 is a partial cross sectional view to show the reciprocation unit connected to the shoveling device of the present invention, wherein the shoveling blade moves forward.
Figure 6:
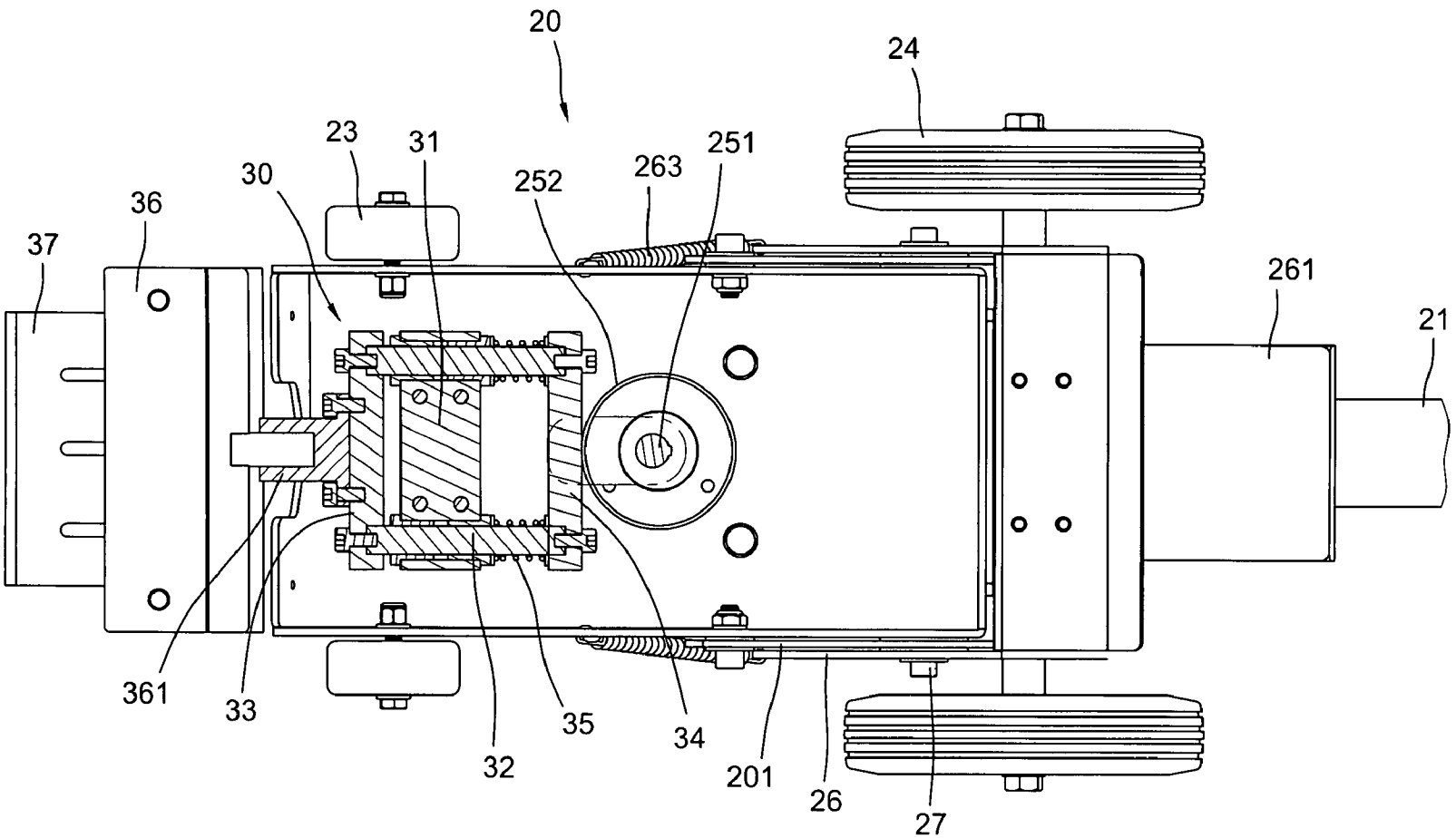
FIG. 6 is a partial cross sectional view to show the reciprocation unit connected to the shoveling device of the present invention, wherein the shoveling blade moves backward.

As shown in FIGS. 5 and 6, when the motor 25 is activated, the eccentric shaft 251 drives the circular member 252 to rotate which pushes the rear board 34 periodically. Because the front board 33 is connected with the rear board 34 via the posts 32 so that the front board 33 are moved back and forth, and the shoveling blade 37 are moved linearly and reciprocally with the movement of the front board 33. The movement of the shoveling blade 37 can easily shovel the tiles or bricks up.

Figure 7:
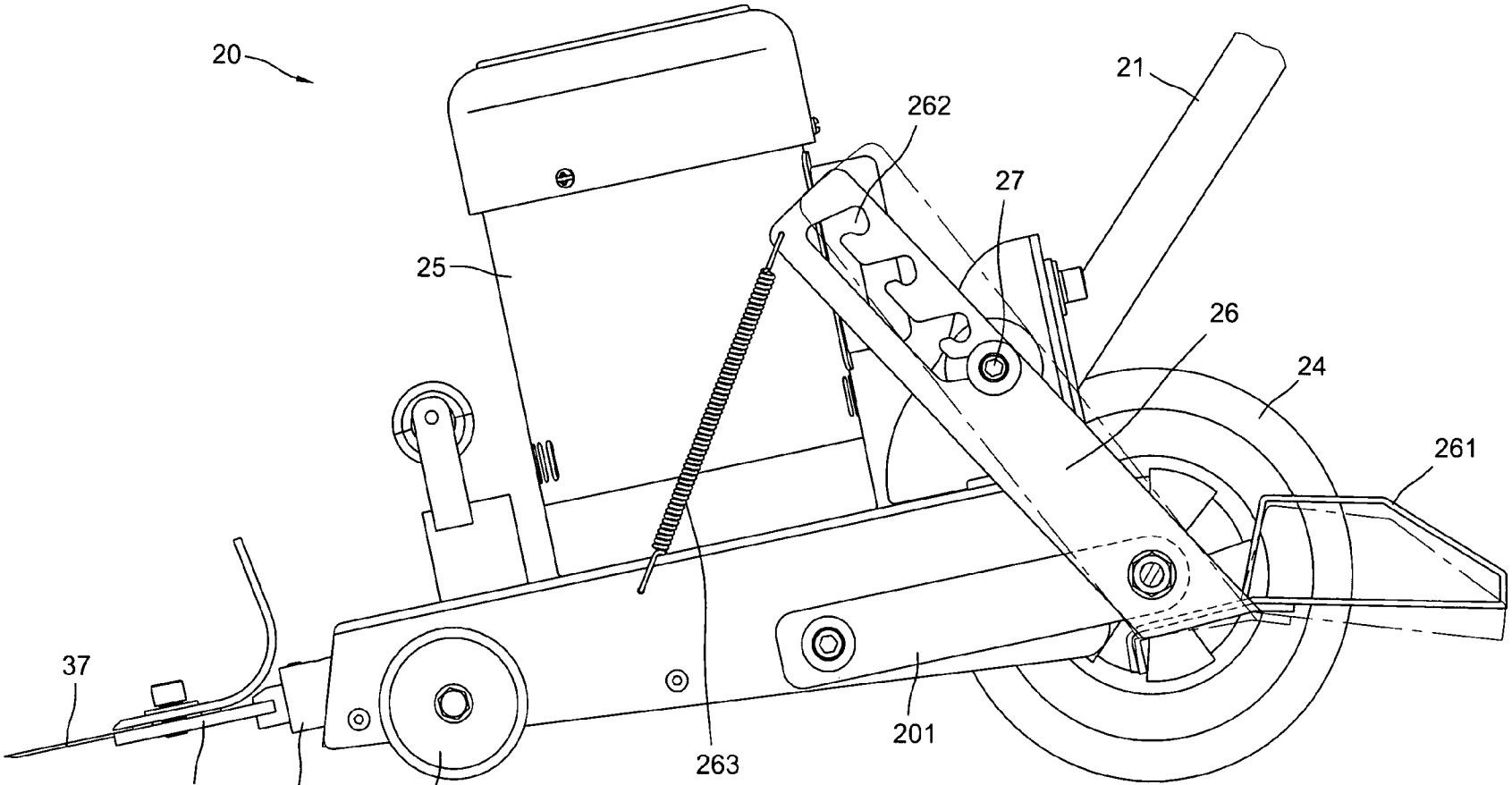
FIG. 7 shows that the adjustment plates are adjusted by operation of the pedal.
Figure 8:
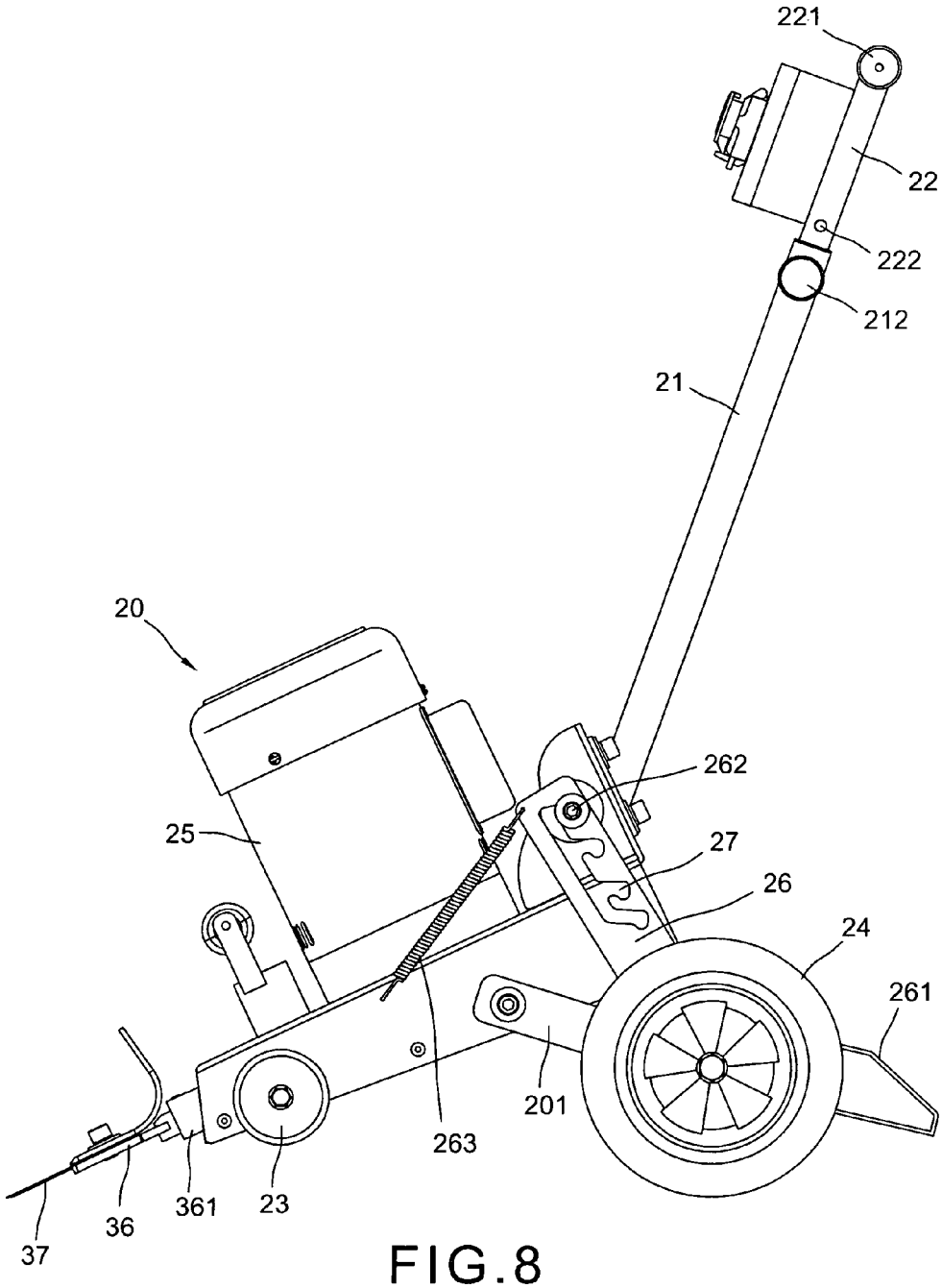
FIG. 8 shows that the angle of the body and the shoveling blade are adjusted to a desired angle.

As shown in FIGS. 7 and 8, the angle of the shoveling blade 37 can be adjusted so as to meet different types of shoveling tasks. The user can step the pedal 261 downward to pivot the adjustment unit to pivot abut the rear wheel axles 241, such that the engaging bolts 27 are disengaged from the positioning slots 262 of the adjustment plates 26. The body 20 is then can be adjusted its angle relative to the floor until the engaging bolts 27 are engaged with the desired positioning slots 262 of the adjustment plates 26 again. The pedal 261 is then released and the engaging bolts 27 position the body 20. The positioning slots 262 can be any known shapes and in this embodiment, the positioning slots 262 includes a straight groove with multiple side slots communicating with the straight groove so as to allow the engaging bolts 27 to be positioned at desired height.

It is noted that the eccentric shaft 251 and the circular member 252 are moved in a circular manner, the shoveling blade 37 moves linearly. The shoveling blade 37 does not shake or swing during operation so that the motor 25 is in operated high efficiency and no dampers are required.

While we have shown and described the embodiment in accordance with the present invention, it should be clear to those skilled in the art that further embodiments may be made without departing from the scope of the present invention.

What is claimed is:

1. A tiles or bricks shoveling device comprising:

a body having front wheels and rear wheels connected thereto, a handle connected to a rear end of the body, a motor connected to the body and including an eccentric shaft which drives a circular member, and a reciprocation unit including a block fixed to the body and at least one post movably extending through the block, a front board connected to a front end of the at least one post and a rear board connected to a rear end of the at least one post, a spring connected to the at least one post to return the rear board, a shoveling blade connected to a front end of the front board and moving linearly with the front board.

2. The device as claimed in claim 1, wherein a blade frame is connected to the front board and a connection plate is connected to the blade frame, the shoveling blade is connected to the connection plate.

3. The device as claimed in claim 1, wherein an operation pedal is connected between the two rear wheels and an adjustment unit is connected to the operation pedal, the adjustment unit includes two adjustment plates and each adjustment plate includes multiple positioning slots, a spring is connected between one of the two adjustment plates and the body, two engaging bolts are located on two sides of the body and each are engaged with one of the positioning slots of the adjustment plate corresponding thereto.

4. The device as claimed in claim 3, wherein the adjustment unit is pivotably connected to two respective axles of the two rear wheels, two links are pivotably connected between the body and the two axles of the two rear wheels.

5. The device as claimed in claim 1, wherein there are two posts movably extend through the block and two springs are located between the block and the posts, the springs bias the rear board.

6. The device as claimed in claim 1, wherein an outer tube extends from the rear end of the body and an inner tube is retractably inserted into the outer tube, the inner tube is connected with the handle, a through hole is defined through a wall of the outer tube and the inner tube has multiple holes, a positioning pin extends through the through hole and is engaged with one of the holes to position the inner tube relative to the outer tube.

* * * * *